US008070447B2

(12) United States Patent
Itou et al.

(10) Patent No.: US 8,070,447 B2
(45) Date of Patent: Dec. 6, 2011

(54) CEILING FAN

(75) Inventors: Shigeo Itou, Aichi (JP); Kiminobu Yamamoto, Aichi (JP); Tetsuji Kawazu, Aichi (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 12/690,979

(22) Filed: Jan. 21, 2010

(65) Prior Publication Data

US 2010/0129225 A1 May 27, 2010

Related U.S. Application Data

(63) Continuation of application No. PCT/JP2008/002074, filed on Aug. 1, 2008.

(30) Foreign Application Priority Data

Aug. 7, 2007 (JP) ..... 2007-205288
Nov. 12, 2007 (JP) ..... 2007-292835

(51) Int. Cl.
*F04D 29/34* (2006.01)

(52) U.S. Cl. ..... 416/210 R; 416/236 R; 416/237; 416/238

(58) Field of Classification Search ..... 416/140, 416/142, 210 R, 220 A, 219 A, 234, 235, 416/236 R, 237, 238, 239, 248
See application file for complete search history.

(56) References Cited

U.S. PATENT DOCUMENTS 4,046,488 A * 9/1977 Wickham ..... 416/210 R
4,508,958 A * 4/1985 Kan et al. ..... 392/364
5,330,323 A * 7/1994 Swanson ..... 416/219 A
5,462,412 A * 10/1995 Scofield et al. ..... 416/210 R
5,542,819 A * 8/1996 Bucher et al. ..... 416/146 R
6,010,308 A * 1/2000 Youn ..... 416/237
6,247,894 B1 * 6/2001 Moody et al. ..... 416/5
6,250,884 B1 * 6/2001 Huang ..... 416/207

FOREIGN PATENT DOCUMENTS

JP 25-5375 8/1950
JP 53-32646 3/1978

(Continued)

OTHER PUBLICATIONS

International Search Report of PCT Application No. PCT/JP2008/002074 dated Aug. 1, 2008.

*Primary Examiner* — Nathaniel Wiehe
(74) *Attorney, Agent, or Firm* — Panasonic Patent Center; Dhiren Odedra; Kerry Culpepper

(57) ABSTRACT

A ceiling fan comprising a disc-like stator provided with a fixed shaft at the center, an annular rotor disposed in proximity to the periphery of the stator, a supporting frame fixed to the rotor and rotatably supported by the fixed shaft; a fan blade fixed to the supporting frame; and a retaining member having one end fixed to the supporting frame together with the fan blade and the other end coupled to the fan blade, wherein the fan blade comprises a root portion fixed to the supporting frame, a blade portion coupled with the retaining member, and an offset portion formed by bending between the root portion and the blade portion, thereby preventing the fan blade from being damaged easily even when it is impressed with a load and ensuring the safety even if the fan blade is broken since the blade portion is held coupled to the rotor side.

18 Claims, 11 Drawing Sheets

FOREIGN PATENT DOCUMENTS

| | | |
|---|---|---|
| JP | 58-60998 | 4/1983 |
| JP | 60-90596 | 6/1985 |
| JP | 60-178911 | 11/1985 |
| JP | 02-188693 | 7/1990 |
| JP | 3-30599 | 3/1991 |
| JP | 09-040096 | 2/1997 |
| JP | 3803475 B | 8/2006 |
| JP | 2006-278211 | 10/2006 |

* cited by examiner

CEILING FAN

CROSS-REFERENCE TO RELATED APPLICATIONS

The present application is a national stage application of international application PCT/JP08/002,074, which claims foreign priority to Japanese Patent Application No. 2007-205288 filed on Aug. 7, 2007 and Japanese Patent Application No. 2007-292835 filed on Nov. 12, 2007, the contents all of which are incorporated herein by reference.

TECHNICAL FIELD

The present invention relates to a ceiling fan used either indoors or outdoors especially by mounting it to a ceiling surface.

BACKGROUND ART

A ceiling fan of a type hitherto known has fan blades sandwiched and fixed between a supporting frame and a rotor as disclosed, for instance, in Patent Literature 1.

Referring to FIG. 15A and FIG. 15B description is provided hereinafter of a conventional ceiling fan. FIG. 15A is a cross sectional view showing a main part of the conventional ceiling fan and FIG. 15B is a plan view showing a part of a fan blade of the ceiling fan.

As shown in these figures, the conventional ceiling fan comprises disc-like stator 103 provided with shaft 104 inserted in and fixed to the center thereof, and annular rotor 105 disposed in close proximity to the periphery of stator 103. The conventional ceiling fan also comprises cap-shaped upper supporting frame 101 and lower supporting frame 102 fixed to the top and bottom of rotor 105 and rotatably supported by shaft 104, and a plurality of fan blades 115 disposed radially by having their one ends inserted into a plurality of slots provided around the periphery of upper supporting frame 101.

Fan blades 115 are inserted between upper supporting frame 101 and rotor 105 when they are fixed to rotor 105. This structure helps retain fan blades 115 temporarily and facilitate the fixing work more conveniently. The structure can also hold fan blades 115 robustly against a load in the vertical direction since fixed portions of fan blades 115 have many areas of contact in their upper and lower surfaces after they are fixed to rotor 105.

As described, the conventional ceiling fan has the structure designed to fix fan blades 115 directly to rotor 105 such that it does not require any special member for mounting fan blades 115 to rotor 105.

When using fan blades 115 made specifically of a metallic material, however, it becomes necessary to lighten a weight of metallic fan blades 115 by reducing their thickness, and this consequently weakens their rigidity and strength. This gives rise to a possibility that fan blades 115 become damaged due to metal fatigue resulting from repeated imposition of the load during a long term of use since stresses concentrate on root portions of fan blades 115 as a reaction of the air being thrust downward.

It is therefore necessary for the conventional ceiling fan of the above kind to have fan blades 115 of such a shape that is not easily damaged in the root portions, and a structure for preventing fan blades 115 from coming off rotor 105 even if they are broken at the root portions.

On the other hand, there is another type of conventional ceiling fan disclosed in Patent Literature 2, which is designed to ensure safety even when fan blades are broken in the proximity of their root portions.

Description is provided hereinafter of the ceiling fan with reference to FIG. 16. FIG. 16 is an exploded perspective view showing a fan blade portion and a retaining member of the conventional ceiling fan as they are being assembled.

As shown in FIG. 16, the conventional ceiling fan comprises cowling 120, which is rotatable with a rotor (not shown), and fan blades 121 attached to cowling 120 by means of retaining members 123. Retaining members 123 and fan blades 121 are mounted to cowling 120 with screws while one ends 123*a* of retaining members 123 are held in alignment with mounting portions 121*a* of fan blades 121. Each of retaining members 123 is formed of a long strip of metal plate extending from one end 123*a* to other end 123*b* in a direction of the distal end of fan blade 121, and the other end 123*b* is fastened to the surface of fan blade 121 at a point of a given distance away from the one end 123*a*. While an area adjacent to mounting portion 121*a* of fan blade 121 is liable to gradual deterioration due to fatigue with time, a separated piece of fan blade 121 is kept connected to cowling 120 with retaining member 123 even when any of fan blades 121 is broken near its one end 123*a*. This structure can thus prevent fan blades 121 from separating from the main unit and falling below, thereby ensuring safety in the surrounding area.

The conventional ceiling fan of this kind has a comparatively small load exerted on retaining members 123 when a synthetic resin is used for the material of fan blades 121. A problem exists, however, in the case of using fan blade assemblies, each consisting of a metallic blade frame and a metallic fan-blade plate. That is, the metallic fan blade assemblies are generally composed of fan-blade plates of a small thickness and blade frames of a thickness larger than the fan-blade plates in order to reduce their weight. As the thickness of the blade frames is decreased in an attempt to reduce the material and the weight, however, the blade frames lose their physical strength. This may lead to breakage of the fan blades due to metal fatigue caused by repeated imposition of load during a long term of use since stresses developed by the blade surfaces to downwardly thrust the air act upon the blade frames via the fan-blade plates and concentrate on their root portions. It therefore becomes necessary to provide some measures for preventing broken pieces of the fan blade assemblies from coming off the main unit even when using the fan blade assemblies consisting of the blade frames and the fan-blade plates.

Patent Literature 1: Japanese Patent Unexamined Publication, No. 1990-188693

Patent Literature 2: Japanese Patent, No. 3,803,475

SUMMARY OF THE INVENTION

The present invention is to provide a ceiling fan comprising any of a fan-blade plate and a fan-blade frame made especially of a metal and mounted to a rotor of a motor, wherein any of the fan-blade plate and the fan-blade frame is formed into a shape not easily damaged even when subjected to repeated impression of a load, and capable of retaining the fan-blade plate connected to the rotor side in a manner not to separate even if any of the fan-blade plate and the fan-blade frame is broken, thereby ensuring the safety.

The ceiling fan of the present invention comprises a disc-like stator provided with a fixed shaft at the center thereof, an annular rotor disposed to the periphery of the stator, a supporting frame fixed to the rotor and rotatably supported by the fixed shaft, a fan blade fixed to the supporting frame, and a retaining member having one end fixed to the supporting frame together with the fan blade and the other end coupled to the fan blade, wherein the fan blade includes a root portion fixed to the supporting frame, a blade portion coupled to the retaining member and an offset portion formed between the root portion and the blade portion.

It becomes possible by virtue of this structure to prevent any of the fan-blade plate and the fan-blade frame made of metals or the like materials composing the fan blade mounted to the rotor of the motor from being damaged easily even when any of them is subjected to repeated impression of a load during operation of the ceiling fan. The structure can also ensure the safety even if the fan blade is broken at an area adjacent to the root portion or the offset portion by retaining a broken piece of the fan blade with the retaining member and preventing it from falling below.

REFERENCE MARKS IN THE DRAWINGS

Figure 1:
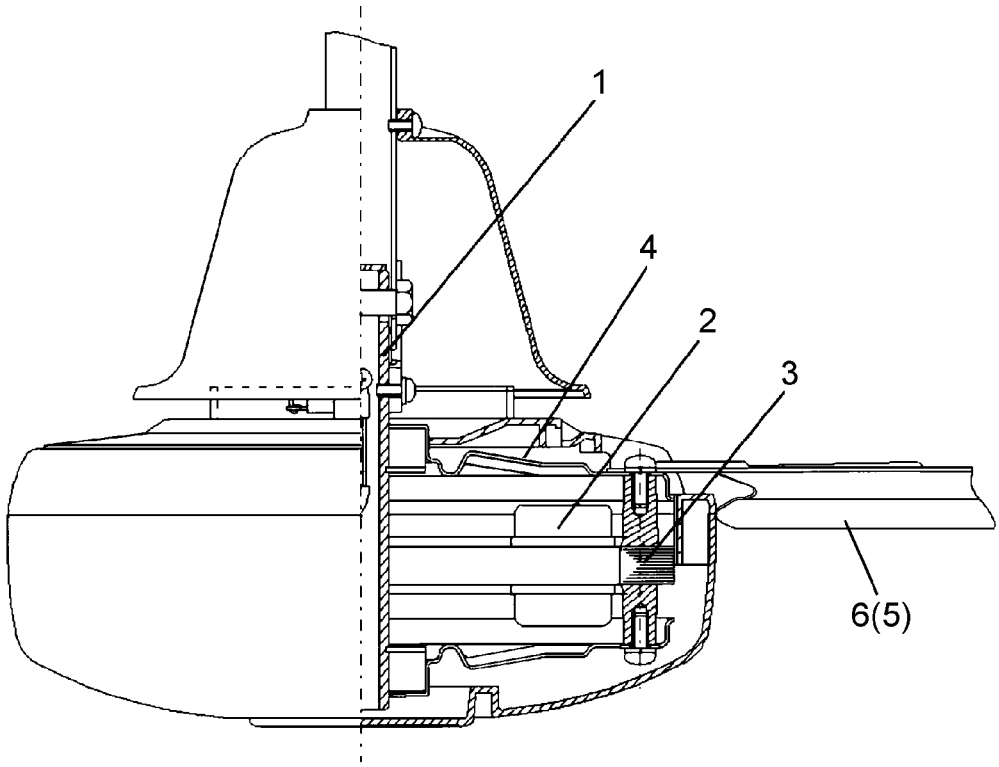
FIG. 1 is a cross sectional view showing a main part of a ceiling fan according to a first exemplary embodiment of the present invention.

1 Fixed shaft
2 Stator
3 Rotor
4 Supporting frame
4*a* Hole
5 Fan blade
6 Fan-blade plate
6*a*, 7*a* Root portion
6*b* Blade portion
6*c*, 7*b* Offset portion
6*d*, 6*e* Reinforcing rib
6*f* Flat portion
6*g* Reinforced end
6*h* Projection
6*r* Curbed portion
7 Fan-blade frame
7*c* Fixing portion
8 Protruding lug
8*a* Lobe portion
8*b* Narrow-neck portion
9, 9A, 9B Retaining member
9*a* Engaging slot
10 Large portion
11 Small portion
12 Flexible wire
12*a* Looped terminal
13 Rivet
14 Lug terminal

DETAILED DESCRIPTION OF PREFERRED EMBODIMENTS

Description is provided hereinafter of the preferred embodiments of the present invention with reference to the accompanying drawings.

First Exemplary Embodiment

Figure 2:
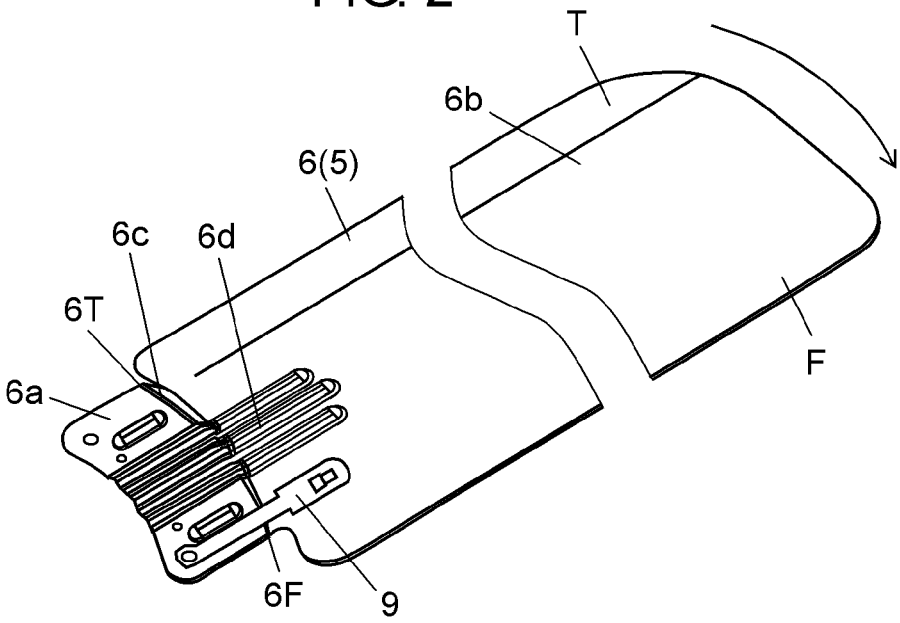
FIG. 2 is a general perspective view showing a fan-blade plate and a retaining member when assembled for the same ceiling fan.

FIG. 1 is a cross sectional view showing a main part of a ceiling fan according to the first exemplary embodiment of the present invention. FIG. 2 is a general perspective view showing a fan-blade plate and a retaining member when assembled for the same ceiling fan. As shown in FIG. 1 and FIG. 2, a motor of the ceiling fan in this exemplary embodiment comprises disc-like stator 2 provided with fixed shaft 1 at the center thereof, and annular rotor 3 disposed in close proximity to the periphery of stator 2. In addition, the ceiling fan has supporting frame 4 fixed to the perimeter of rotor 3, and a plurality of metallic fan-blade plates 6 fixed to supporting frame 4 either permanently or in a removable manner.

In this exemplary embodiment, fan blade 5 comprises fan-blade plate 6 of a unitary structure. In other words, fan-blade plate 6 has root portion 6*a* to be fixed to supporting frame 4 and blade portion 6*b* extending from root portion 6*a*, as shown in FIG. 2, and retaining member 9 is mounted to it for connecting root portion 6*a* and blade portion 6*b*. Fan-blade plate 6 has inclined offset portion 6*c* between root portion 6*a* and blade portion 6*b*.

Offset portion 6*c* has a gradational inclination to form blade portion 6*b* of such a shape that trailing edge T lies in a lower position than leading edge F with respect to a horizontal plane for providing fan-blade plate 6 with the function of producing airflow when it rotates about fixed shaft 1 in the direction of the arrow. In other words, offset portion 6*c* is provided with a gradual difference in the vertical height to make blade portion 6*b* so inclined that the trailing edge T at the exiting side of the airflow lies lower than the leading edge F at the entering side into the airflow as blade portion 6*b* rotates in the direction of the arrow. Accordingly, FIG. 2 shows that offset portion 6*c* is inclined downward from root portion 6*a* toward blade portion 6*b*. Since the trailing edge T of blade portion 6*b* is located lower than the leading edge F, offset portion 6*c* in FIG. 2 has larger offset height 6T at the trailing edge T side than offset height 6F at the leading edge F side.

Figure 7A:
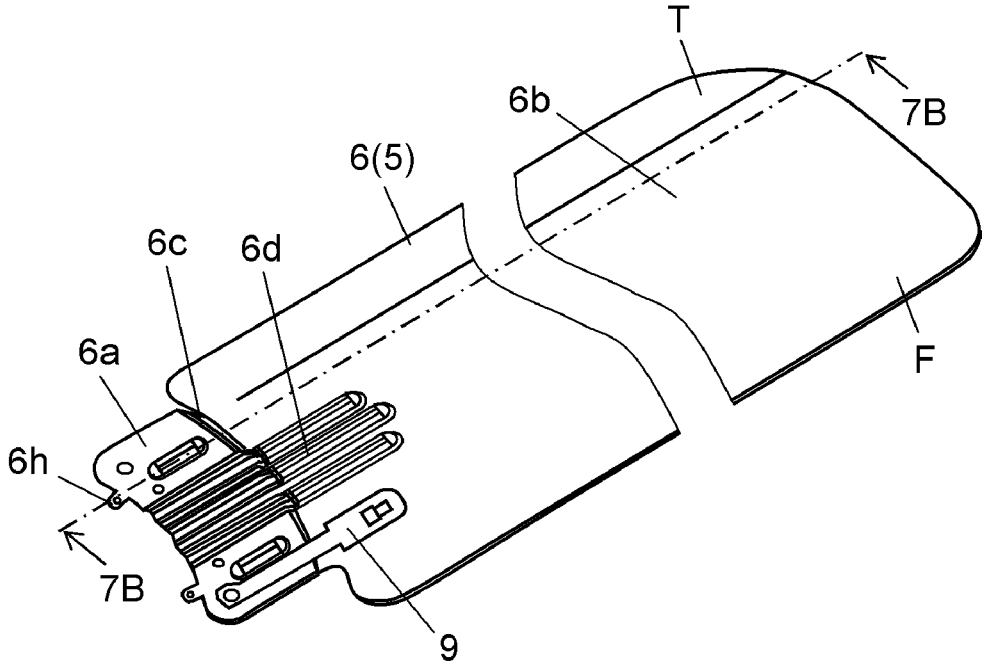
FIG. 7A is a general perspective view showing a fan-blade plate and a retaining member when assembled for a ceiling fan according to a sixth exemplary embodiment of the present invention.
Figure 7B:
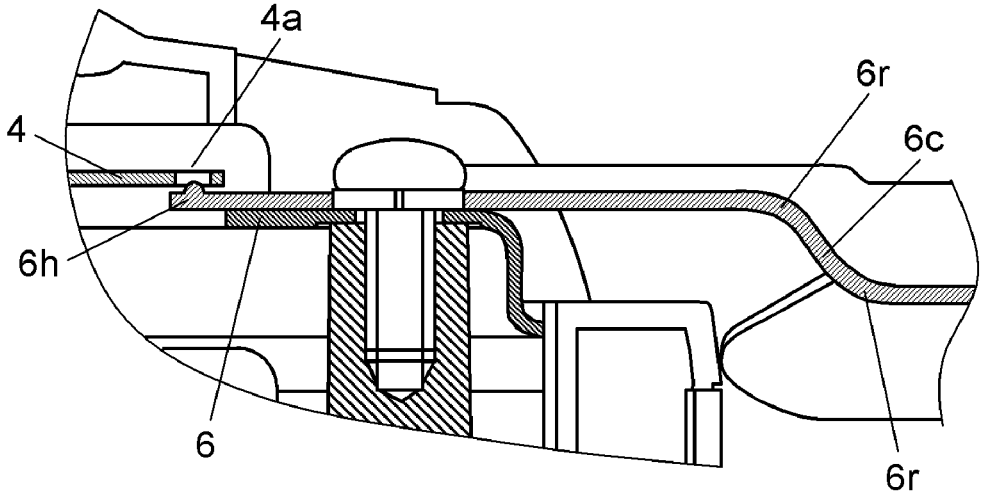
FIG. 7B is a cross sectional view showing a main part of the fan-blade plate assembled to a supporting frame of the ceiling fan according to the sixth exemplary embodiment of the present invention.

In addition, offset portion 6*c* includes two curbed portions 6*r* that are bent to opposite directions to form obtuse angles, or bent angles larger than 90 degrees as shown partially in FIG. 7B.

Fan-blade plate 6 has reinforcing ribs 6*d* of a stripe form extending from root portion 6*a* to blade portion 6*b* at the side near offset portion 6*c*.

Retaining member 9 has one end fixed to supporting frame 4 together with root portion 6*a* and the other end coupled to blade portion 6*b* across offset portion 6*c*.

In the above structure, a reactive force is exerted upon blade portion 6*b* of fan-blade plate 6 when the ceiling fan is operated to generate airflow in a direction from the ceiling to the floor, and it causes concentration of repeated stress on a proximal area of root portion 6*a* of fan-blade plate 6. This gives rise to a possibility that the area near root portion 6*a* of fan-blade plate 6 breaks due to metal fatigue when used for an extended period. In the case of this exemplary embodiment, however, fan-blade plate 6 is held connected to supporting frame 4 of rotor 3 with retaining member 9 even if fan-blade plate 6 is broken, thereby preventing it from falling below.

Fan-blade plate 6 having offset portion 6*c* with the inclination for supporting blade portion 6*b* can improve performance of the ceiling fan such as an amount and velocity of the airflow. This enhances the repeated stress exerted on offset portion 6*c* of fan-blade plate 6 due to the reactive force of blade portion 6*b* against the airflow, which makes offset portion 6*c* the area most susceptible to break. In this exemplary embodiment, however, retaining member 9 mounted across offset portion 6*c* can prevent fan-blade plate 6 from falling below even if it is broken by holding it to supporting frame 4 of rotor 3 by retaining member 9.

It is also obvious that the stress produced by blade portion 6*b* concentrates on the curbed portions of offset portion 6*c*. Since curbed portions 6*r* in this exemplary embodiment are formed into obtuse angles larger that 90 degrees, the stress is distributed over the entire area of root portion 6*a* in fan-blade plate 6 to alleviate concentration of the stress to offset portion 6*c*. This structure can hence make fan-blade plate 6 not easily breakable and improve durability of the fan blade.

Second Exemplary Embodiment

Figure 3:
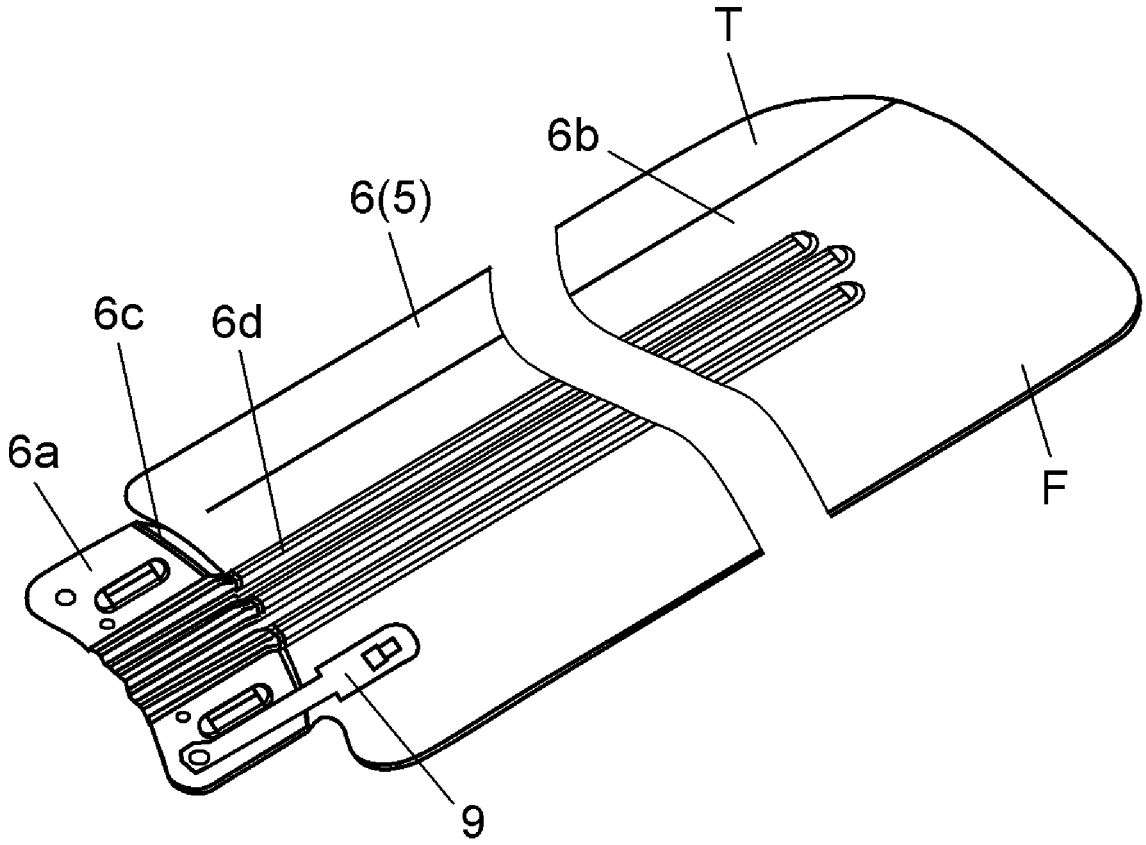
FIG. 3 is a general perspective view showing a fan-blade plate and a retaining member when assembled for a ceiling fan according to a second exemplary embodiment of the present invention.

FIG. 3 is a general perspective view showing a fan-blade plate and a retaining member when assembled for a ceiling fan according to the second exemplary embodiment of the present invention. As shown in FIG. 3, this exemplary embodiment differs from the first exemplary embodiment in respect of that fan-blade plate 6 used as fan blade 5 is provided with reinforcing ribs 6*d* of a stripe form extending from root portion 6*a* to either the center area or near the distal end of blade portion 6*b*.

According to this structure, stripe-formed reinforcing ribs 6*d* can reduce to a large extent warpage of metallic fan-blade plate 6 attributable to its own weight. This structure can also reduce a degree of deformation of fan-blade plate 6 due to repeated impression of a load during the operation and alleviate concentration of the stress to offset portion 6*c* and the like areas. The structure can hence make fan-blade plate 6 not easily breakable.

Third Exemplary Embodiment

Figure 4A:
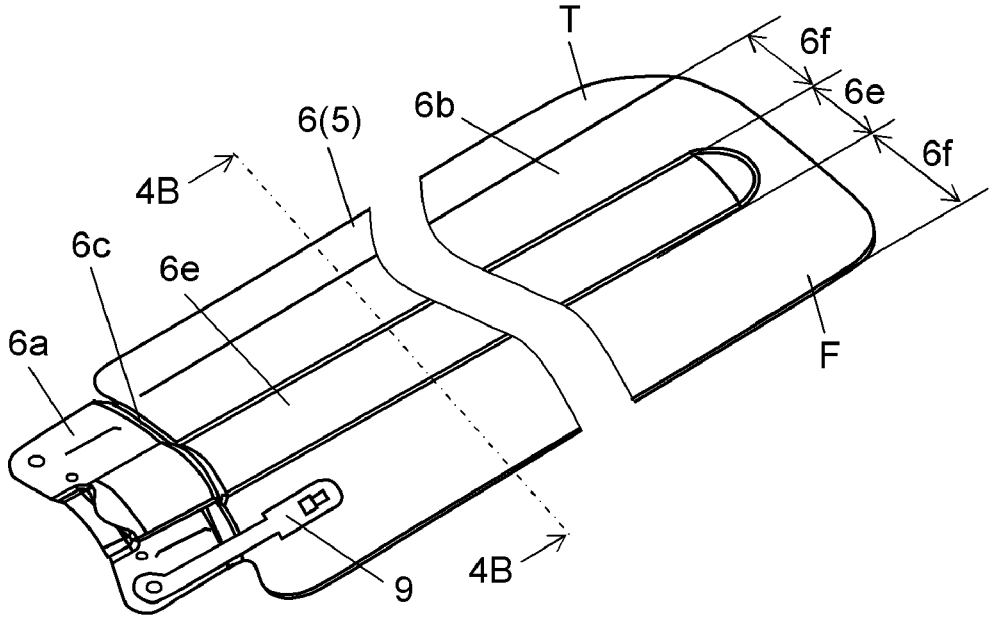
FIG. 4A is a general perspective view showing a fan-blade plate and a retaining member when assembled for a ceiling fan according to a third exemplary embodiment of the present invention.
Figure 4B:
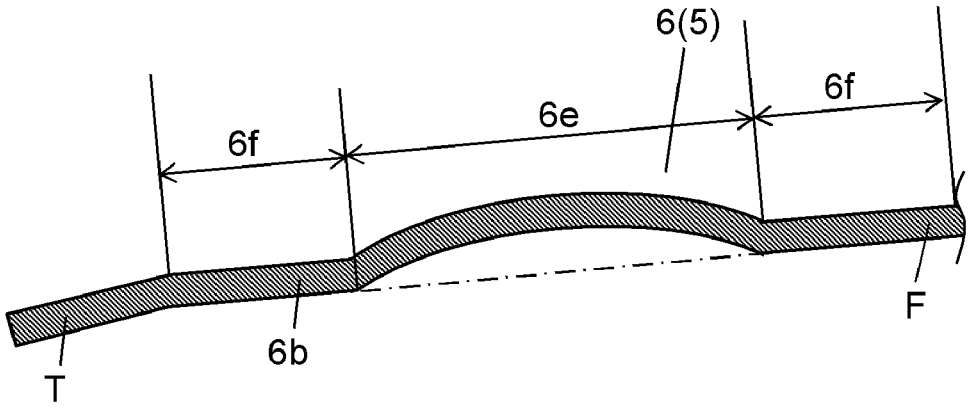
FIG. 4B is a cross sectional view of the fan-blade plate.

FIG. 4A is a general perspective view showing a fan-blade plate and a retaining member when assembled for a ceiling fan according to the third exemplary embodiment of the present invention. FIG. 4B is a cross sectional view of the fan-blade plate taken along a line 4B-4B in FIG. 4A. As shown in FIG. 4A, fan-blade plate 6 constituting fan blade 5 of this exemplary embodiment is provided with reinforcing rib 6*e* extending continuously from root portion 6*a* to the center area or near the distal end of blade portion 6*b* in a manner similar to that of the second exemplary embodiment. However, reinforcing rib 6*e* of this exemplary embodiment has an arc shape of a large radial curvature in cross section extending substantially in the widthwise direction of blade portion 6*b* as shown in FIG. 4B. In addition, blade portion 6*b* has flat areas 6*f* formed at both sides adjoining leading edge F and trailing edge T in a manner that they are flush with each other as shown in FIG. 4B. Here, FIG. 4B illustrates that the trailing edge T is kept to lie in a lower position than the leading edge F by means of the inclination of offset portion 6*c* shown in FIG. 4A.

The structure illustrated above can prevent fan-blade plate 6 from warping and deforming, reduce the areas where the stress concentrates, and improve rigidity of fan-blade plate 6 entirely. This structure also improves flatness of the front and back surfaces of fan-blade plate 6 to help the air to flow smoothly along the surfaces.

Furthermore, flat areas 6*f* provided at both sides adjoining the leading edge F (i.e., entering side of the airflow) and the trailing edge T (i.e., exiting side of the airflow) of blade portion 6*b* improves the rigidity substantially as compared with any such fan-blade plate as formed entirely into an arc shape in cross section. In addition, the above structure can help ensure maintenance and control of the dimensions and the shape of fan-blade plate 6 stably in the metal work during the manufacturing process, and it thereby improves efficiency of the production as well as quality control.

Fourth Exemplary Embodiment

Figure 5:
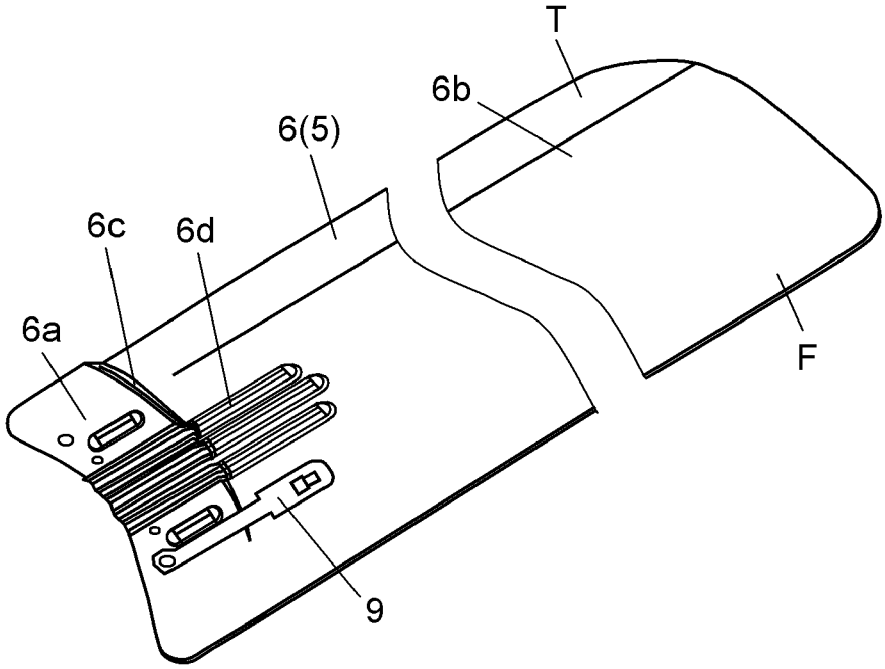
FIG. 5 is a general perspective view showing a fan-blade plate and a retaining member when assembled for a ceiling fan according to a fourth exemplary embodiment of the present invention.

FIG. 5 is a general perspective view showing a fan-blade plate and a retaining member when assembled for a ceiling fan according to the fourth exemplary embodiment of the present invention. As shown in FIG. 5, fan-blade plate 6 used as fan blade 5 of this exemplary embodiment is formed into generally the equal dimension in width from root portion 6*a* to the proximity of a distal end of blade portion 6*b*. In other words, root portion 6*a* of this exemplary embodiment has an area larger than any fan blade 5 in the first through third exemplary embodiments. Accordingly, this structure can increase the mounting strength of root portion 6*a* by having fan-blade plate 6 of the width generally the same dimension throughout from root portion 6*a* to the proximity of the distal end of blade portion 6*b* and increasing the area of root portion 6*a*.

Since fan-blade plate 6 has the width of generally the same dimension from root portion 6*a* to blade portion 6*b*, material lay-out and use of it become easier and more efficient. Moreover, fan-blade plate 6 can be made robustly to avoid cracking in the mounting area even when it receives repeated impression of a load because this exemplary embodiment has a larger area ratio of root portion 6*a* to blade portion 6*b* as compared to those of the first through the third exemplary embodiments, in which fan-blade plates 6 have root portions 6*a* of narrower width than blade portions 6*b*.

In addition, this structure can increase an overall area of root portion 6*a* being secured because of root portion 6*a* having the surface area enlarged by making the width of root portion 6*a* generally the same as the width of blade portion 6*b*. It can thus prevent the stress from concentrating on the mounting area of fan-blade plate 6.

Fifth Exemplary Embodiment

Figure 6:
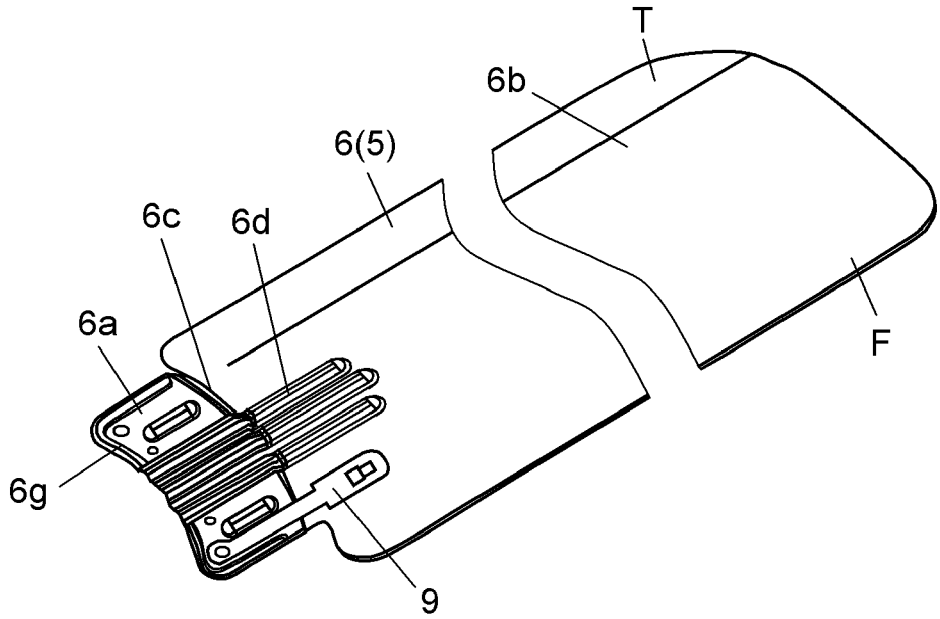
FIG. 6 is a general perspective view showing a fan-blade plate and a retaining member when assembled for a ceiling fan according to a fifth exemplary embodiment of the present invention.

FIG. 6 is a general perspective view showing a fan-blade plate and a retaining member when assembled for a ceiling fan according to the fifth exemplary embodiment of the present invention. As shown in FIG. 6, fan-blade plate 6 used as fan blade 5 of this exemplary embodiment is provided with reinforced end 6*g* at the edge of root portion 6*a* formed by a process such as beading and folding.

Reinforced end 6*g* provided by the process of beading or folding the edge of root portion 6*a* increases the rigidity of root portion 6*a* and prevent fan-blade plate 6 from being broken at root portion 6*a*. This structure can also maintain an adequate strength even when the width of root portion 6*a* is reduced smaller than that of blade portion 6*b*. It can thus allow root portion 6*a* of a slim shape in designing and increase the commercial value of the ceiling fan when the width of root portion 6*a* is formed smaller than blade portion 6*b*.

Sixth Exemplary Embodiment

FIG. 7A is a general perspective view showing a fan-blade plate and a retaining member when assembled for a ceiling fan according to the sixth exemplary embodiment of the present invention, and FIG. 7B is a cross sectional view showing a main part of the fan-blade plate assembled to a supporting frame of the ceiling fan. In this exemplary embodiment, root portion 6*a* is provided with a plurality of projections 6*h* as shown in FIG. 7A, and supporting frame 4 is provided with a plurality of holes 4*a* for projections 6*h* to fit therein as shown in FIG. 7B.

This structure can alleviate the stress exerted on root portion 6*a* since root portion 6*a* is supported by projections 6*h* at the plurality of positions. In addition, the structure helps ease the work of mounting fan-blade plate 6 to supporting frame 4 since fan-blade plate 6 can be retained temporarily by insert-fitting projections 6*h* into holes 4*a* in supporting frame 4 in the process of assembling.

Seventh Exemplary Embodiment

Figure 8:
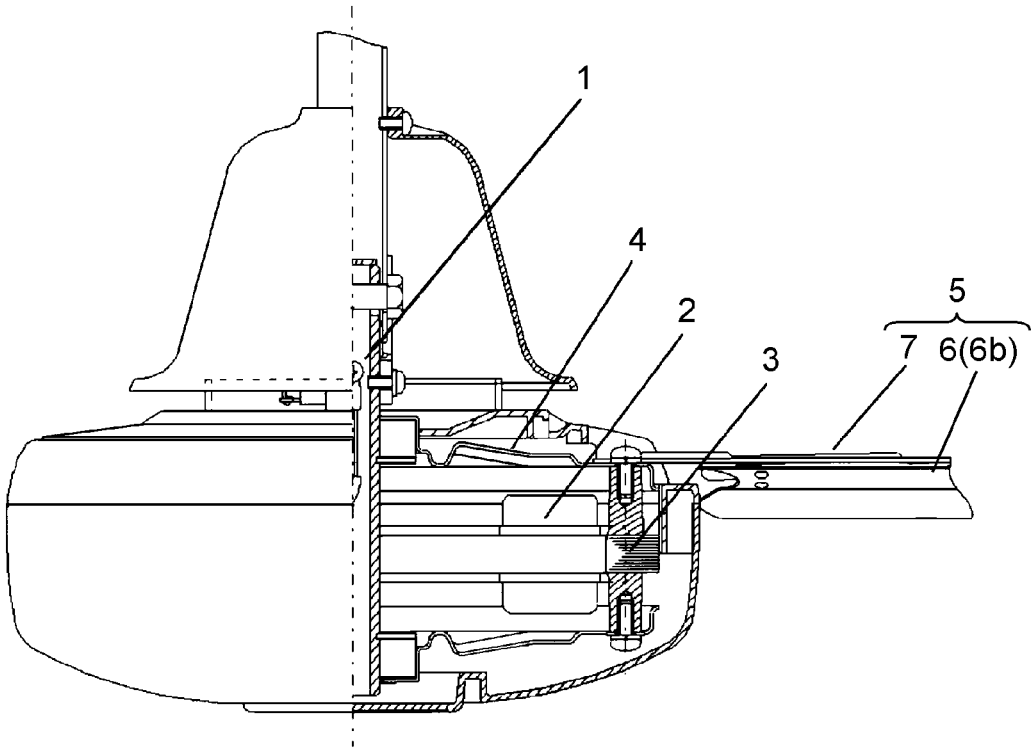
FIG. 8 is a cross sectional view showing a main part of a ceiling fan according to a seventh exemplary embodiment of the present invention.
Figure 9:
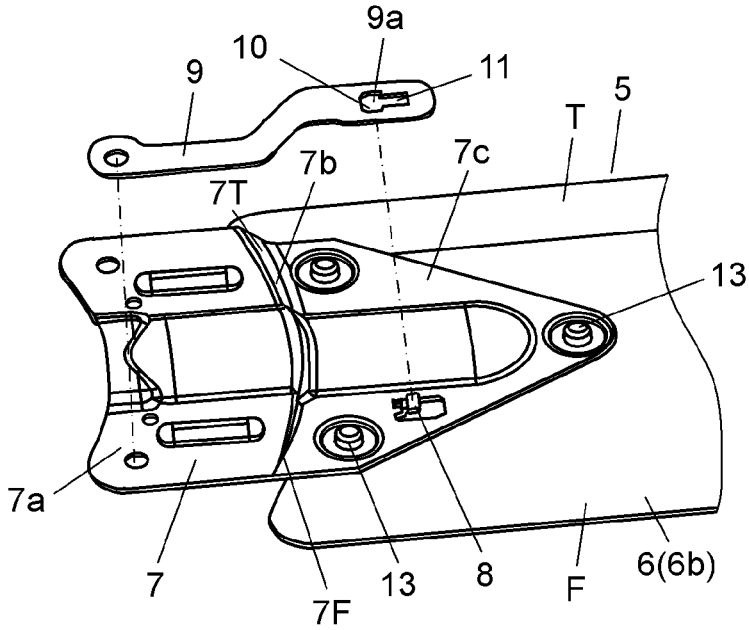
FIG. 9 is an exploded perspective view of a fan blade and a retaining member of the same ceiling fan.
Figure 10A:
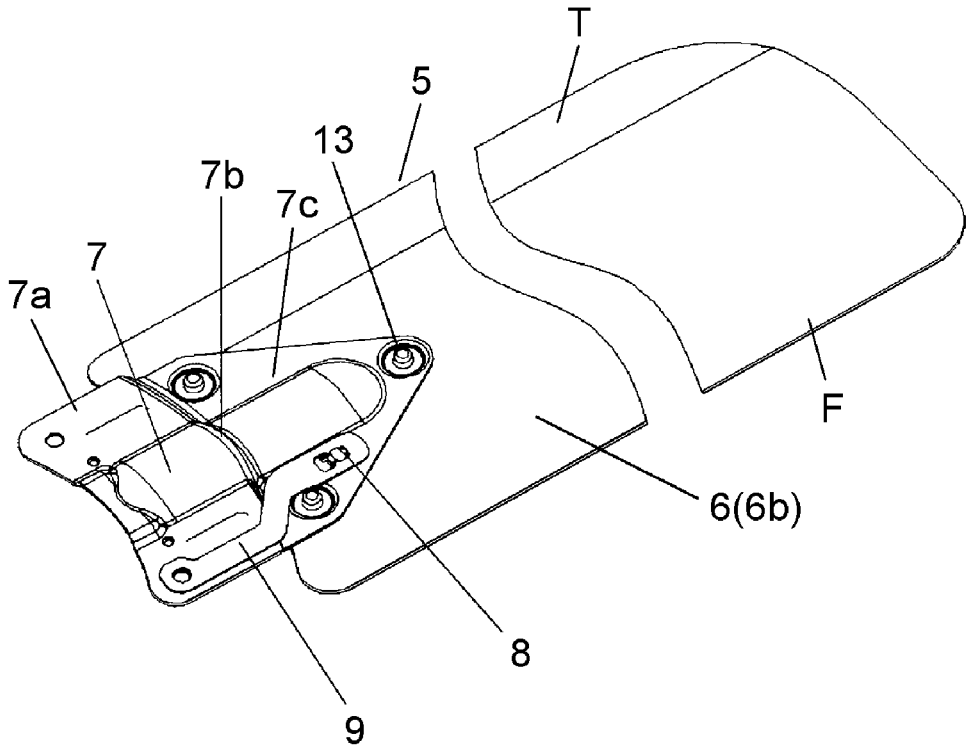
FIG. 10A is a general perspective view showing the fan blade and the retaining member when assembled for the same ceiling fan.
Figure 10B:
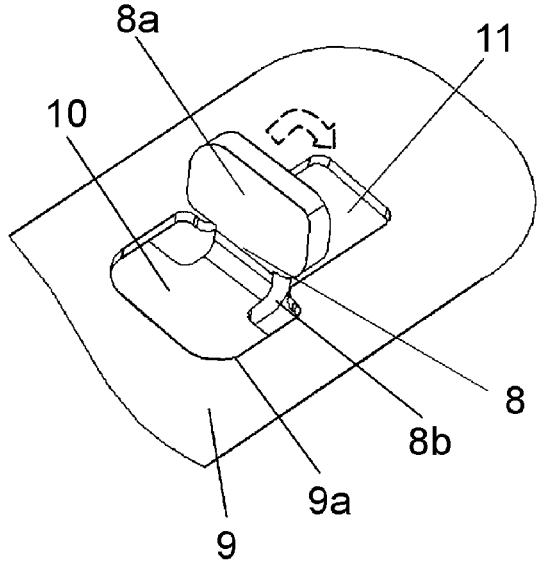
FIG. 10B is an enlarged perspective view of a main part showing a relation between a protruding lug and the retaining member of the same ceiling fan.
Figure 11:
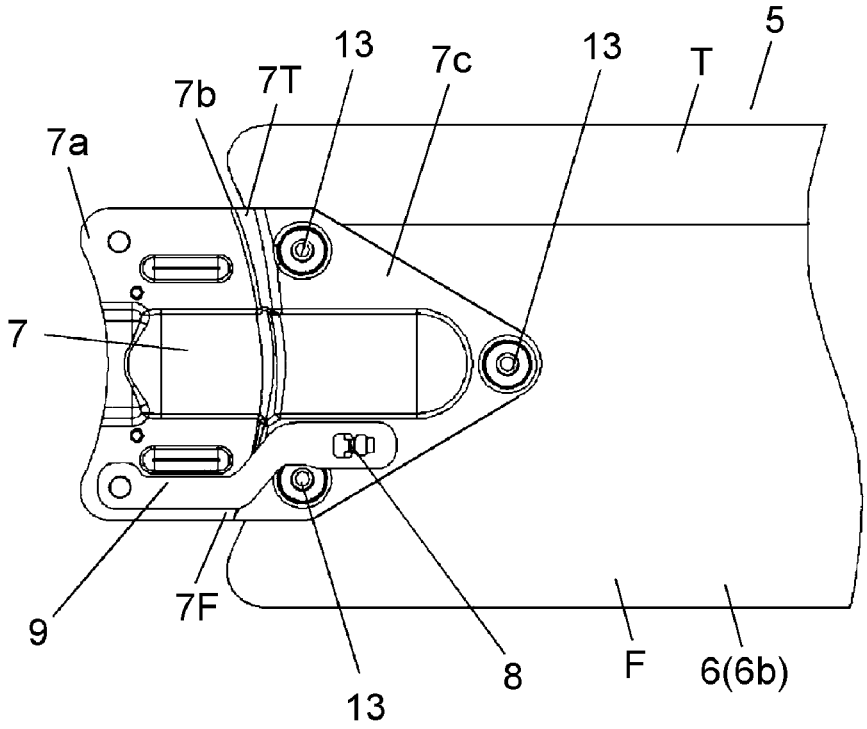
FIG. 11 is a plan view showing the fan blade and the retaining member after assembled.
Figure 12:
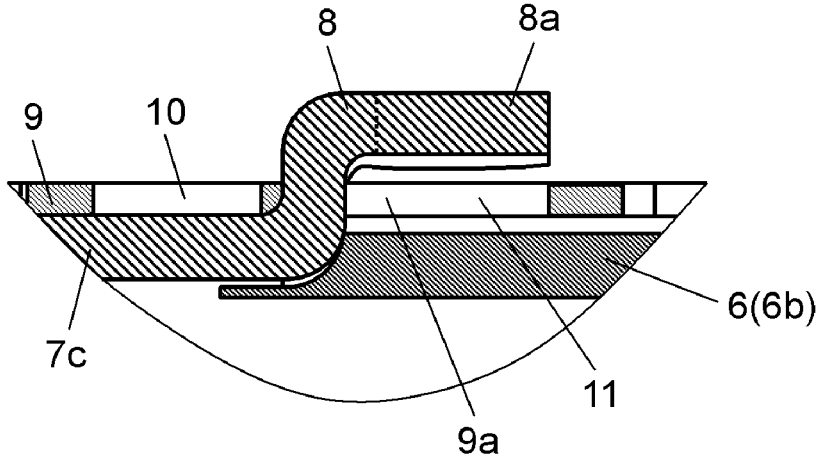
FIG. 12 is a sectional view of a main part showing a relation between the protruding lug and the retaining member.

FIG. 8 is a cross sectional view showing a main part of a ceiling fan according to the seventh exemplary embodiment of the present invention. FIG. 9 is an exploded perspective view of a fan blade and a retaining member of the same ceiling fan. FIG. 10A is a general perspective view showing the fan blade and the retaining member when assembled, and FIG. 10B is an enlarged perspective view of the main part showing a relation between a protruding lug and the retaining member. FIG. 11 is a plan view showing the fan blade and the retaining member after assembled, and FIG. 12 is a sectional view of the main part showing a relation between the protruding lug and the retaining member.

According to this exemplary embodiment, a main unit of the ceiling fan comprises disc-like stator 2 provided with fixed shaft 1 at the center thereof, and annular rotor 3 disposed in close proximity to the periphery of stator 2. In addition, the ceiling fan of this exemplary embodiment has supporting frame 4 fixed to rotor 3 and axially supported by fixed shaft 1 in a rotatable manner, and metallic fan blades 5 fixed to the perimeter of supporting frame 4 either permanently or in a removable manner, as shown in FIG. 8 to FIG. 12.

Fan blade 5 comprises fan-blade frame 7 having one end fixed to supporting frame 4, and fan-blade plate 6 fixed to the other end of fan-blade frame 7, as shown in FIG. 9. That is, fan blade 5 has fan-blade plate 6 made of a metal plate processed to form blade portion 6*b*, and metallic fan-blade frame 7 attached to the rotational center side of fan-blade plate 6. Fan-blade frame 7 has root portion 7*a* to be fixed to supporting frame 4, offset portion 7*b* formed by bending, and fixing portion 7*c* whereto fan-blade plate 6 is fixed. Retaining member 9 is mounted to the surface of fan-blade frame 7. One end of retaining member 9 is fixed to supporting frame 4 by a screw together with root portion 7*a* of fan-blade frame 7, and the other end of retaining member 9 is extended across offset portion 7*b* and coupled to protruding lug 8 provided on fixing portion 7*c* of fan-blade frame 7 at fan-blade plate 6 side.

That is, protruding lug 8 has narrow portion ("neck-side portion") 8*b* coupled with fan-blade frame 7 and lobe portion ("tip-end portion") 8*a* linked with narrow portion 8*b*, wherein lobe portion 8*a* is formed larger in size than narrow portion 8*b*, as shown in FIG. 10B. There is engaging slot 9*a* formed near the end of retaining member 9 of a size to make engagement loosely with protruding lug 8. Engaging slot 9*a* in retaining member 9 has a shape resembling a keyhole consisting of large portion ("first hole") 10 and small portion ("second hole") 11 connected to each other. Lobe portion 8*a* of protruding lug 8 has a size smaller than large portion 10 of engaging slot 9*a* but larger than small portion 11. Lobe portion 8*a* can be engaged with a certain clearance to engaging slot 9*a* at the end of retaining member 9.

Protruding lug 8 is formed by press-lifting a part of fan-blade frame 7 into a bendable hook. Lobe portion 8*a* of protruding lug 8 has a size insertable into large portion 10 of engaging slot 9*a* provided in retaining member 9, and narrow portion 8*b* of protruding lug 8 is formed in a position to fit into small portion 11 in retaining member 9. In the case of this exemplary embodiment, lobe portion 8*a* and narrow portion 8*b* of protruding lug 8 are set to 5.5 mm and 3 mm in widths respectively. Wide portion 10 and small portion 11 of engaging slot 9*a* are set to 6.3 mm and 4 mm in widths respectively.

The inclined offset portion 7*b* is provided in fan-blade frame 7 to have fan-blade plate 6 fixed with an inclination so maintained that trailing edge T at the exiting side of airflow tilts downward from leading edge F at the entering side of the airflow with respect to a horizontal plane when fan-blade plate 6 rotates about fixed shaft 1. Accordingly, offset portion 7*c* has a larger offset height at 7T side than 7F side. In addition, offset portion 7*b* is bent to an obtuse angle larger than 90 degrees, and retaining member 9 is disposed in a position to cross one side of offset portion 7*b* having the smaller offset height, in the like manner as offset portion 6*c* discussed in the first exemplary embodiment with reference to FIG. 7B.

In the above structure, a reactive force of the airflow is exerted in the vertical direction upon fan-blade plate 6 when the ceiling fan of this exemplary embodiment is operated, and this gives rise to a possibility that the area around offset portion 7*b* or the mounting portion of fan-blade frame 7 breaks due to metal fatigue resulting from concentration of internal stress. By virtue of this structure, however, fan-blade frame 7 and fan-blade plate 6 can be held connected to supporting frame 4 by retaining member 9 without separating from the main unit even if fan-blade frame 7 is broken due to the metal fatigue attributable to an extended period of use.

This structure can also make connection of retaining member 9 to protruding lug 8 without producing a tensile stress in retaining member 9 by loosely engaging protruding lug 8 in engaging slot 9*a* of retaining member 9. Protruding lug 8 is formed at the side facing fan-blade plate 6 and away from offset portion 7*b* of fan-blade frame 7 that is liable to become damaged. This also helps maintain reliable engagement of protruding lug 8 with engaging slot 9*a* of retaining member 9 to ensure the connection of fan-blade frame 7 and fan-blade plate 6 to supporting frame 4 in an event that fan-blade frame 7 is broken.

The structure also ensure reliably the engagement of lobe portion 8*a* of protruding lug 8 with small portion 11 of engaging slot 9*a* in retaining member 9 because fan-blade plate 6 shifts outward by a distance of the clearance when fan-blade frame 7 is damaged. The broken fan-blade frame 7 and fan-blade plate 6 can therefore be kept retained by retaining member 9 in a manner to hang from supporting frame 4.

Lobe portion 8*a* of press-lifted protruding lug 8 is inserted through large portion 10 of engaging slot 9*a* provided in retaining member 9, and neck portion 8*b* of protruding lug 8 is fitted inside small portion 11 in retaining member 9. Retaining member 9 can be thus engaged easily to protruding lug 8 while maintaining their dimensional relationship having the clearance, and it can be fixed temporarily by bending protruding lug 8 to the direction of a dotted arrow shown in FIG. 10B. At the final assembly, fan-blade plate 6 is fixed to supporting frame 4 together with retaining member 9 by using a screw or the like fastening means.

Since fan-blade frame 7 is securely fixed to rotor 3, a pressure exerted on fan-blade plate 6 as a reactive force of the airflow concentrates on offset portion 7*b* that holds fan-blade plate 6 with an inclination. However, the stress is distributed over the entire area of fan-blade frame 7 to alleviate concentration of the stress onto offset portion 7*b* because offset portion 7*b* is formed by bending it into obtuse angles larger that 90 degrees and this structure can hence improve durability of offset portion 7*b*.

As discussed, offset portion 7*b* is provided with a gradual difference in the vertical height in the widthwise direction of fan-blade frame 7 and retaining member 9 is disposed to cross one side of offset portion 7*b* having the smaller offset height. This structure allows retaining member 9 formed into a plain shape of flat plate to help simplify the overall shape and reduce the manufacturing cost of retaining member 9.

Eighth Exemplary Embodiment

Figure 13:
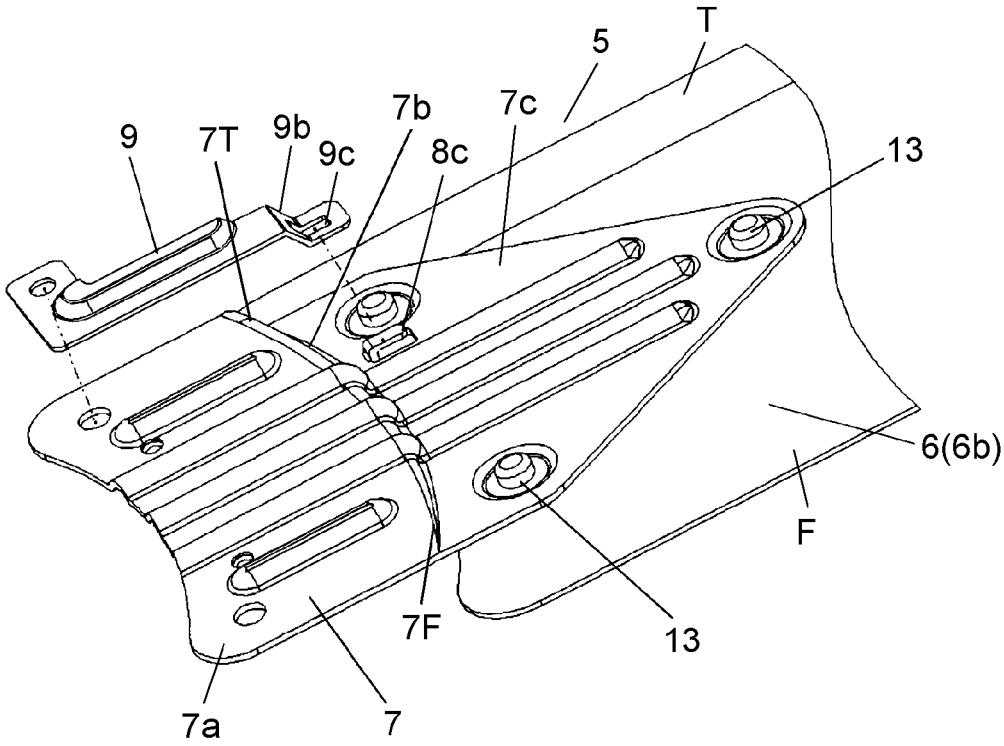
FIG. 13 is an exploded perspective view showing a relation between a fan-blade plate and a retaining member according to an eighth exemplary embodiment of the present invention.

FIG. 13 is an exploded perspective view showing a relation between a fan blade and a retaining member of a ceiling fan according to the eighth exemplary embodiment of the present invention. Similar to the seventh exemplary embodiment, fan blade 5 of this exemplary embodiment comprises fan-blade frame 7 and fan-blade plate 6, and that fan-blade frame 7 comprises root portion 7*a*, offset portion 7*b* and fixing portion 7*c*.

In this exemplary embodiment, retaining member 9 is provided with bent portion 9*b* of a shape formed to fit along offset portion 7*b* of fan-blade frame 7 as shown in FIG. 13. There is engaging slot 9*c* formed in bent portion 9*b*, which is connected to protruding lug 8*c* formed on fixing portion 7*c*. One of the ends of retaining member 9 is fixed to supporting frame 4 together with root portion 7*a* by using a screw or the like fastening means.

Retaining member 9 of this structure provided with bent portion 9*b* of the shape to fit along offset portion 7*b* can reduce an air resistance during rotation and prevent retaining member 9 from being separated or deformed even when equipped with fan-blade frame 7 having offset portion 7*b* of a large vertical height.

According to this exemplary embodiment as discussed, bent portion 9*b* formed in retaining member 9 to fit along offset portion 7*b* ensures mounting of retaining member 9 without leaving a risk of coming off fan-blade frame 7 while also reducing the air resistance when the fan blade rotates. Retaining member 9 of this shape can also prevent deformation and ensure the safety even when fan-blade frame 7 is damaged.

Ninth Exemplary Embodiment

Figure 14A:
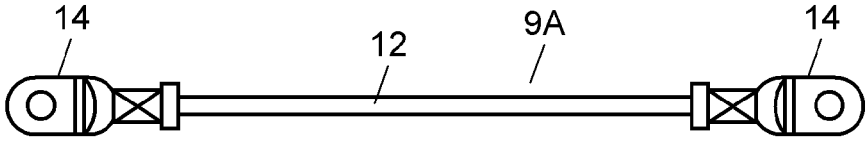
FIG. 14A is a plan view of a retaining member according to a ninth exemplary embodiment of the present invention.
Figure 14B:
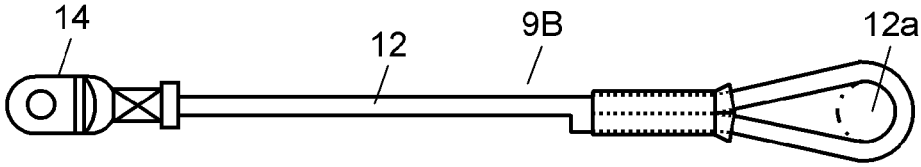
FIG. 14B is a plan view of another retaining member of the same exemplary embodiment.
Figure 15A:
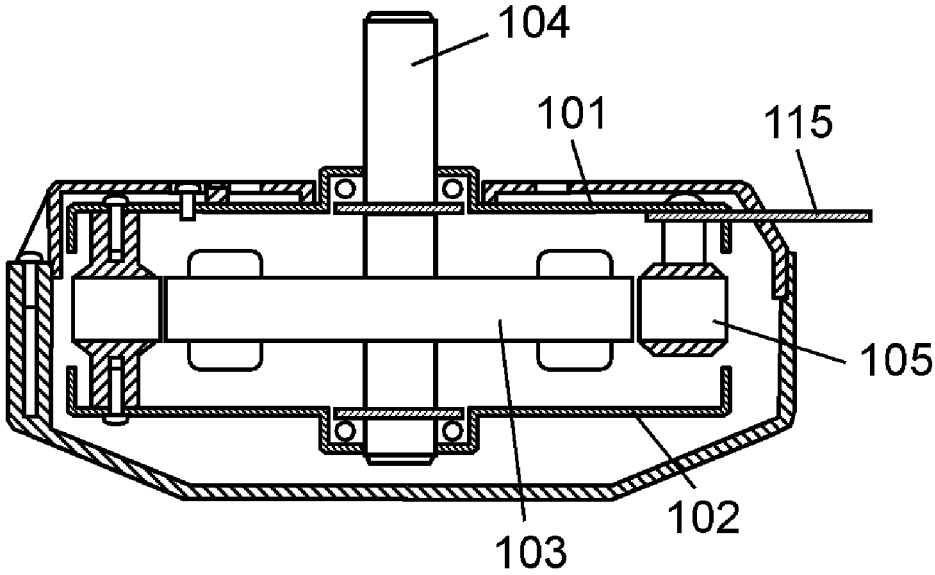
FIG. 15A PRIOR ART
FIG. 15A is a cross sectional view of a conventional ceiling fan.
Figure 15B:
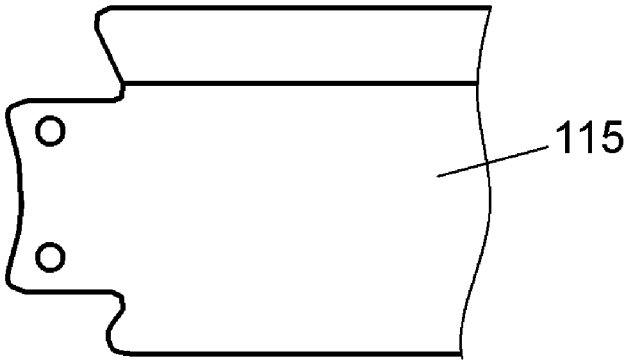
FIG. 15B PRIOR ART
FIG. 15B is a plan view showing a main part of a fan blade of the ceiling fan.
Figure 16:
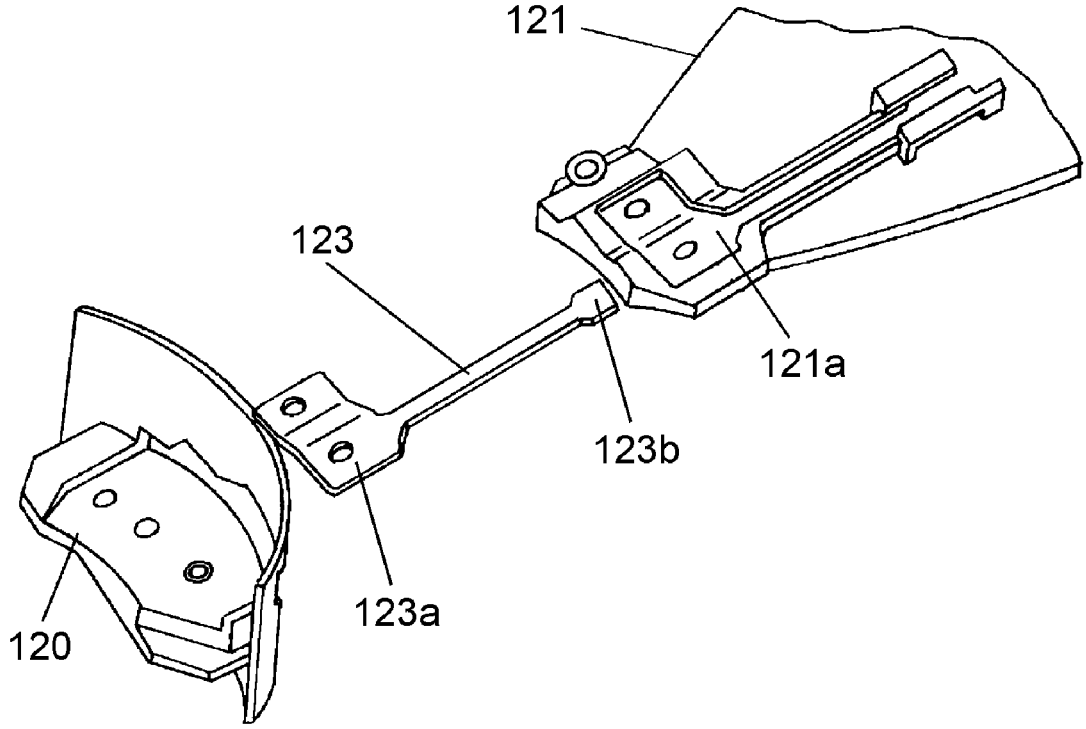
FIG. 16 PRIOR ART
FIG. 16 is an exploded perspective view showing a fan-blade plate and a retaining member when assembled for the conventional ceiling fan.

FIG. 14A is a plan view of a retaining member of a ceiling fan, and FIG. 14B is a plan view of another retaining member according to the ninth exemplary embodiment of the present invention.

As shown in FIG. 14A, retaining member 9A has lug terminals 14 at both ends of flexible wire 12, which is less susceptible to concentration of bending stress, and one of lug terminals 14 is formed connectable to protruding lug 8 of fan-blade frame 7.

Similarly, retaining member 9B comprises flexible wire 12, and it is provided with lug terminal 14 at one end and looped terminal 12*a* formed by circularly curving the other end of flexible wire 12, as shown in FIG. 14B. This looped terminal 12*a* is formed connectable to protruding lug 8 of fan-blade frame 7.

Retaining member 9B can be attached easily to protruding lug 8 of fan-blade frame 7 by hooking looped terminal 12*a* at the end of flexible wire 12. In addition, retaining member 9B makes one of lug terminals 14 unnecessary for the connection of flexible wire 12 as compared to retaining member 9A, thereby reducing the number of parts.

Both retaining members 9A and 9B can be used for any of ceiling fans in the first through the eighth exemplary embodiments.

As discussed above, retaining members 9A and 9B comprised of flexible wire 12 have a high degree of flexibility in the manner they are installed so that they are adaptable to a wide variety of applications without any restriction on the shape of fan-blade frame 7. Since flexible wire 12 is composed of a stranded wire having flexibility, it can alleviate the stress even when it is used in such a location as to cross offset portion 7*b* where repeated deformation is likely to occur. By virtue of having flexible wire 12, any of retaining members 9A and 9B is capable of keeping fan-blade frame 7 connected to supporting frame 4 even if fan-blade frame 7 is broken.

According to this exemplary embodiment, it becomes possible to standardize the retaining members for ceiling fans since retaining members 9A and 9B are comprised of flexible wire 12 and their applications are not restricted by the height and shape of offset portion 7*b* of fan-blade frame 7. Retaining members 9A and 9B can also demonstrate satisfactorily their function as the retaining means when fan-blade frame 7 is broken since they are not easily damaged by the stress attributable to repeated deformation. Furthermore, retaining member 9B improves the efficiency of assembling since looped terminal 12*a* at the end of flexible wire 12 facilitates the mounting, while also reducing the number of parts.

INDUSTRIAL APPLICABILITY

The present invention is applicable to large electric fans and ventilating fans used indoors and outdoors, and particularly to air-blowing apparatuses of which fan blades or fan-blade frames receive large loads, since the invented structure reduces the stress exerted on the fan blades during operation, prevents the fan blades from being damaged due to aging fatigue attributed to repeated impression of the load, and avoid the fan blades from falling below even if they are broken.

The invention claimed is:

1. A ceiling fan comprising:

a disc-like stator provided with a fixed shaft at the center thereof;

an annular rotor disposed to the periphery of the stator;

a supporting frame fixed to the rotor and rotatably supported by the fixed shaft;

a fan blade fixed to the supporting frame; and a retaining member having one end fixed to the supporting frame together with the fan blade and the other end coupled to the fan blade, wherein the fan blade comprises in a unitary structure:

a root portion fixed to the supporting frame;

a blade portion coupled to the retaining member; and an offset portion formed between the root portion and the blade portion, wherein the offset portion is inclined downward from the root portion toward the blade portion, and wherein an offset height is at a trailing edge side of the blade portion larger than at a leading edge side of the blade portion.

2. The ceiling fan of claim 1, wherein the trailing edge of the fan blade is located lower than the leading edge of the fan blade, and the retaining member is disposed in a manner to cross the offset portion.

3. The ceiling fan of claim 1, wherein the offset portion includes two curbed curved portions that are bent to in directions opposite to each other into obtuse bent angles.

4. The ceiling fan of claim 1, wherein the fan blade is provided with a reinforcing rib extending continuously from the root portion to the center area of the blade portion.

5. The ceiling fan of claim 4, wherein the reinforcing rib of the fan blade has an arc shape in cross section extending substantially in a widthwise direction of the blade portion.

6. The ceiling fan of claim 4, wherein the blade portion of the fan blade has flat areas formed at both sides adjoining a leading edge and a trailing edge in a manner that they are flush with each other.

7. The ceiling fan of claim 1, wherein the fan blade is formed into generally the have an even dimension in width from the root portion to a distal end of the blade portion.

8. The ceiling fan of claim 1, wherein the fan blade is provided with a reinforced end at the edge of the root portion formed by any of beading process and folding process.

9. The ceiling fan of claim 1, wherein the fan blade is provided with a plurality of projections in the root portion, and the supporting frame is provided with a plurality of holes for the projections to fit therein.

10. The ceiling fan of claim 1, wherein the retaining member comprises a flexible wire.

11. The ceiling fan of claim 10, wherein the retaining member has a looped terminal formed by circularly curving one end of the flexible wire, and the looped terminal is connected to the fan blade.

12. A ceiling fan comprising:

a disc-like stator provided with a fixed shaft at the center thereof;

an annular rotor disposed to the periphery of the stator;

a supporting frame fixed to the rotor and rotatably supported by the fixed shaft;

a fan blade fixed to the supporting frame; and a retaining member having one end fixed to the supporting frame to ether with the fan blade and the other end coupled to the fan blade, wherein:

the fan blade comprises a fan-blade frame having one end fixed to the supporting frame, and a fan-blade plate fixed to the other end of the fan-blade frame;

the fan-blade frame has an offset portion formed between the one end fixed to the supporting frame and the other end fixed to the fan-blade plate, the fan blade frame and the offset portion are formed in a single body; and one end of the retaining member is fixed to the supporting frame together with the one end of the fan-blade frame, and the other end is extended across the offset portion and coupled to the other end of the fan-blade frame, wherein the offset portion is inclined downward from the one end fixed to the supporting frame toward the other end fixed to the fan blade plate in the fan blade frame, and wherein an offset height is at a trailing edge side of the blade portion larger than at a leading edge side of the blade portion.

13. The ceiling fan of claim 12, wherein the other end of the fan-blade frame where the fan-blade plate is fixed is provided with a protruding lug comprising a neck-side portion continuous with the other end of the fan-blade frame and a tip-end portion continuous with the neck-side portion, the tip-end portion is formed larger in size than the neck-side portion, and one end of the retaining member has an engaging slot of a size to make engagement loosely with the neck-side portion of the protruding lug.

14. The ceiling fan of claim 13, wherein the engaging slot has a shape comprising a first hole and a second hole connected with the first hole and of a size smaller than the first hole, and the tip-end portion of the protruding lug has a size smaller than the first hole but larger than the second hole of the engaging slot so that the end of the retaining member is connectable to the protruding lug with a clearance.

15. The ceiling fan of claim 14, wherein the protruding lug of the fan-blade frame is formed into a press-lifted shape having the tip-end portion insertable into the first hole of the engaging slot provided in the retaining member and the neck-side portion fittable into the second hole in the retaining member.

16. The ceiling fan of claim 12, wherein the offset portion of the fan-blade frame is bent to an obtuse angle.

17. The ceiling fan of claim 12, wherein the offset portion of the fan-blade frame has two offsets of different heights, and the retaining member is disposed in a position to cross one of the offsets having a smaller height.

18. The ceiling fan of claim 12, wherein the retaining member has a bent portion of a shape fitting along the offset portion of the fan-blade frame.

* * * * *